US007841576B2

(12) United States Patent
Miller et al.

(10) Patent No.: US 7,841,576 B2
(45) Date of Patent: Nov. 30, 2010

(54) OVERHEAD HANGER UNIT FOR CONCRETE CURB FORMS

(75) Inventors: Thomas E. Miller, Mequon, WI (US); Erik C. Peterson, Milwaukee, WI (US); Larry O. Oleson, South Milwaukee, WI (US)

(73) Assignee: Metal Forms Corporation, Milwaukee, WI (US)

( * ) Notice: Subject to any disclaimer, the term of this patent is extended or adjusted under 35 U.S.C. 154(b) by 962 days.

(21) Appl. No.: 11/590,167

(22) Filed: Oct. 31, 2006

(65) Prior Publication Data

US 2008/0099657 A1 May 1, 2008

(51) Int. Cl.
*E01C 19/50* (2006.01)
*E04G 17/12* (2006.01)

(52) U.S. Cl. ..... 249/8; 249/208

(58) Field of Classification Search ..... 249/2, 249/3, 4, 5, 6, 7, 8, 9, 34, 208, 219.1; 269/37, 269/43, 45

See application file for complete search history.

(56) References Cited

U.S. PATENT DOCUMENTS

| | | | | |
|---|---|---|---|---|
| 877,870 | A | 1/1908 | Shone et al. | |
| 1,067,420 | A | 7/1913 | Forbis | |
| 1,109,433 | A | 9/1914 | Leydecker et al. | |
| 1,279,059 | A * | 9/1918 | Whiteway et al. | 249/8 |
| 1,615,178 | A * | 1/1927 | Moss et al. | 249/8 |
| 1,628,316 | A * | 5/1927 | Heltzel | 249/5 |
| 1,637,998 | A * | 8/1927 | Heitzel | 249/5 |
| 1,644,584 | A | 10/1927 | Heltzel | |
| 1,644,586 | A | 10/1927 | Heltzel | |
| 1,644,587 | A | 10/1927 | Heltzel | |
| 1,770,518 | A | 7/1930 | Harrold | |
| 2,140,669 | A | 12/1938 | De Vigier | |
| 2,298,837 | A | 10/1942 | Oswald | |
| 2,635,320 | A | 4/1953 | Ornitz | |
| 2,846,570 | A * | 8/1958 | Harling | 362/396 |
| 2,849,745 | A * | 9/1958 | Madsen | 15/268 |
| 2,894,310 | A * | 7/1959 | Hogan et al. | 249/208 |
| 3,207,465 | A | 9/1965 | Papin | |
| 3,288,426 | A | 11/1966 | Simpson | |
| 3,561,713 | A * | 2/1971 | Berkowitz | 248/242 |

(Continued)

*Primary Examiner*—Michael Safavi
(74) *Attorney, Agent, or Firm*—Greer, Burns & Crain, Ltd.

(57) ABSTRACT

An overhead hanger unit for concrete forms, with a first hanger form having a first portion engagable with a first curb form and a second portion extending from the first portion, and a second hanger form having a first portion engagable with a second curb form and a second portion extending from the first portion. A pin may be carried on the second portion of the first hanger form and a slot may be formed in the second portion of the second hanger form, wherein the second portion of the second hanger form may be aligned with the second portion of the first hanger form and the pin engaged with the slot. A coupling device may be engagable with the pin to secure the first hanger form to the second hanger form at a selected position such that a distance from the first curb form to the second curb form may be adjusted by an amount substantially equal to a length of the slot. A pivot connection may be provided between the first portion of the second hanger form and the second portion of the second hanger form, such that the first portion may be rotated at an angle relative to the second portion.

20 Claims, 7 Drawing Sheets

U.S. PATENT DOCUMENTS

| | | | | | |
|---|---|---|---|---|---|
| 3,743,232 | A | * | 7/1973 | Vaughan | 249/34 |
| 4,029,288 | A | | 6/1977 | Murphy et al. | |
| 4,066,237 | A | | 1/1978 | Bentz | |
| 4,339,106 | A | | 7/1982 | Navarro | |
| 4,494,725 | A | | 1/1985 | Sims | |
| 4,836,487 | A | | 6/1989 | Ringler | |
| 5,048,781 | A | | 9/1991 | Breen | |
| 5,076,536 | A | * | 12/1991 | Fitzgerald | 249/219.1 |
| 5,156,753 | A | * | 10/1992 | Speidel | 249/5 |
| 5,205,942 | A | * | 4/1993 | Fitzgerald | 249/3 |
| D374,096 | S | | 9/1996 | Fischer | |
| 6,234,447 | B1 | | 5/2001 | Boyden et al. | |
| 6,367,764 | B1 | | 4/2002 | Butler | |
| 6,390,440 | B1 | | 5/2002 | Morin | |
| 6,591,574 | B2 | | 7/2003 | Humphrey | |
| 6,629,681 | B1 | | 10/2003 | Miller et al. | |
| 6,820,868 | B1 | * | 11/2004 | Reymus | 269/41 |
| 6,866,239 | B2 | | 3/2005 | Miller et al. | |
| 7,182,309 | B1 | * | 2/2007 | Olsen | 249/219.1 |
| 2005/0218277 | A1 | * | 10/2005 | Shaw et al. | 248/201 |
| 2005/0241264 | A1 | * | 11/2005 | Albano | 52/781.5 |

* cited by examiner

OVERHEAD HANGER UNIT FOR CONCRETE CURB FORMS

FIELD OF THE INVENTION

The present invention relates generally to concrete forms and, more particularly, to an overhead hanger unit for concrete forms.

BACKGROUND OF THE INVENTION

Concrete forms are used for forming the edges of concrete structures, such as sidewalks and roads. Particularly in the case of roads, oftentimes concrete curbs are formed which have a face elevated above the road surface which faces the road. The curb may have a thickness which may vary from road to road, so sometimes along the same road, thus requiring the forms used to form the back side and the face of the curb to be held at different distances from each other. Also, the face of the curb may be perpendicular to the road surface, or it may be laid back from perpendicular by an angle, that again may vary from road to road, or along the same road.

Various arrangements have been provided in the art for adjusting the distance of the curb face form from the back form, which in some instances require that only discrete distance changes are permitted, and in some instances require a complicated fastening or adjusting arrangement.

Various arrangements have been provided in the art for adjusting the angle of the curb face form from the back form, again, which in some instances require a complicated fastening or adjusting arrangement.

It would be advantageous in the art if an overhead hanger unit were provided that permitted a simple adjustability of the distance of the back form from the curb face form, and also a simple adjustability of the angle of the front face form.

SUMMARY OF THE INVENTION

In an embodiment of the invention, an overhead hanger unit for concrete forms is provided which includes a first hanger form having a first portion engagable with a first curb form and a second portion extending from the first portion, and a second hanger form having a first portion engagable with a second curb form and a second portion extending from the first portion. A pin is fixed to the second portion of the first hanger form. A slot is formed in the second portion of the second hanger form, wherein the second portion of the second hanger form may be aligned with the second portion of the first hanger form and the pin engaged with the slot. A coupling device is engagable with the pin to secure the first hanger form to the second hanger form at a selected position such that a distance from the first curb form to the second curb form may be adjusted by an amount substantially equal to a length of the slot.

In an embodiment, the slot in the second hanger form opens to one end of the second portion.

In an embodiment, the pin has an external thread and the coupling device is an internally threaded member formed as a clamping knob with an enlarged grasping diameter.

In an embodiment, the first portion of the first hanger form includes a plate for attaching to the curb form.

In an embodiment, the second portion of the first hanger form has an L shape cross section and the second portion of the second hanger form has an L shape cross section.

In an embodiment, a pivot connection is provided between the first portion of the second hanger form and the second portion of the second hanger form, such that the first portion may be rotated at an angle relative to the second portion.

In an embodiment, an overhead hanger unit for concrete forms is provided including a first hanger form having a first portion engagable with a first curb form and a second portion extending from the first portion, and a second hanger form having a first portion engagable with a second curb form and a second portion extending from the first portion. A pivot connection is provided between the first portion of the second hanger form and the second portion of the second hanger form, such that the first portion may be rotated at an angle relative to the second portion.

In an embodiment, the pivot connection comprises a pair of spaced apart pins carried by one of the first portion and the second portion of the second hanger form and a series of spaced holes arranged in an arc to selectively receive one of the pins and an arcuate slot to receive the other of the pins, formed in the other of the first portion and the second portion of the second hanger form, and a coupling device arranged to securely engage with one of the pins to secure the first portion to the second portion at a selected angle.

In an embodiment, five holes are arranged on the second portion of the second hanger form to receive the pin carried on the first portion of the second hanger form.

In an embodiment, the coupling unit is engagable with the pin extending through the slot which has an external thread and the coupling device is an internally threaded member formed as a clamping knob with an enlarged grasping diameter.

In an embodiment, the first portion of the first hanger form includes a plate for attaching to the curb form.

In an embodiment, the second portion of the first hanger form has an L shape cross section and the second portion of the second hanger form has an L shape cross section.

In an embodiment, a concrete curb forming system is provided which includes a first curb form arranged to form a back of a curb, the first curb form having a planar front face and a rear face with a pair of opposed channels formed therein, a second curb form arranged to form a face of the curb, the second curb form having a planar front face and a rear face with a pair of opposed channels formed therein, and an overhead hanger unit. The overhead hanger unit includes a first hanger form having a first portion engagable with the channels of the first curb form and a second portion extending from the first portion, and a second hanger form having a first portion engagable with the channels of the second curb form and a second portion extending from the first portion. A pin is carried on the second portion of the first hanger form. An open ended slot is formed in the second portion of the second hanger form, wherein the second portion of the second hanger form may be aligned with the second portion of the first hanger form and the pin engaged with the slot. A coupling device is engagable with the pin to secure the first hanger form to the second hanger form at a selected position such that a distance from the first curb form to the second curb form may be adjusted by an amount substantially equal to a length of the slot.

In an embodiment, the first portion of the first hanger form includes a plate for rotatingly engaging with the channels in the first curb form.

In an embodiment, the curb forms are made of plastic.

The features and advantages described in this disclosure and in the following detailed description are not all-inclusive, and particularly, many additional features and advantages will be apparent to one of ordinary skill in the relevant art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

These and other more detailed features of the present invention are more fully disclosed in the following specification, reference being to the accompany drawings, in which.

The Figures depict embodiments consistent with the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

The following description provides specific details for a thorough understanding of, and enabling description for, embodiments of the invention. However, one skilled in the art will understand that the invention may be practiced without these details. In other instances, well known structures and functions have not been shown or described in detail to avoid unnecessarily obscuring the description of the embodiments of the invention.

Figure 1:
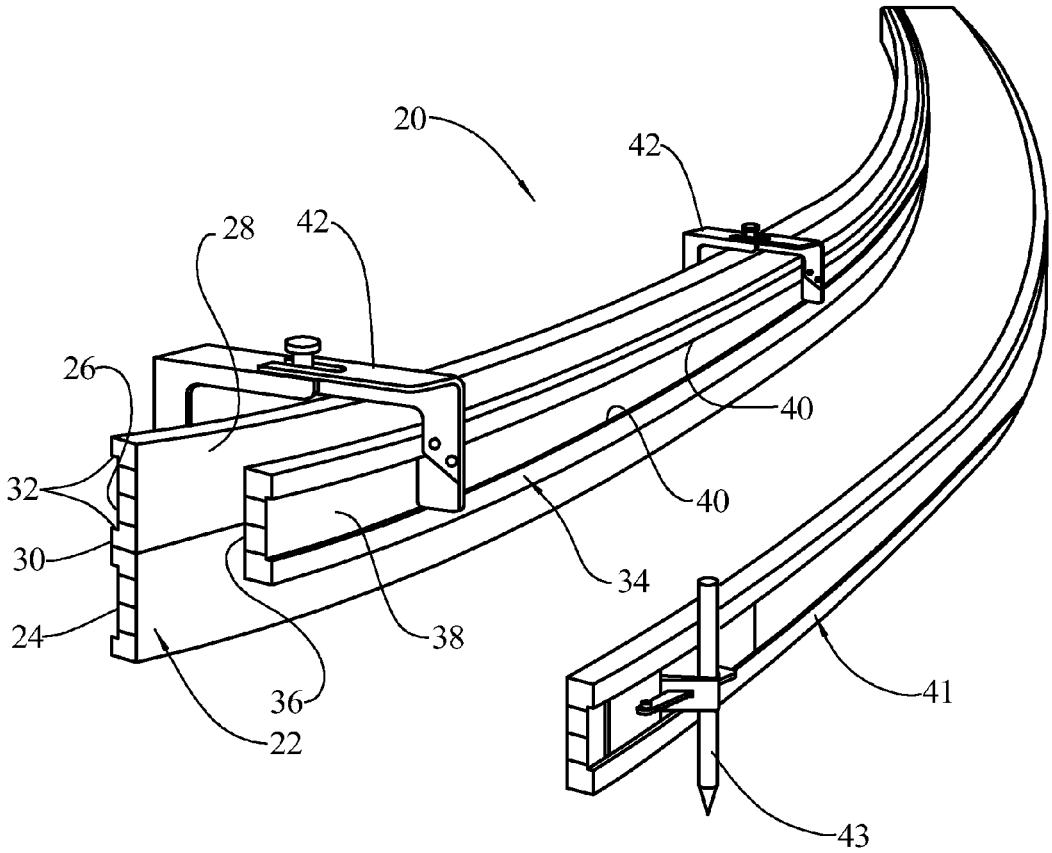
FIG. 1 is a depiction of a concrete curb forming system embodying the principles of the present invention.

FIG. 1 illustrates a concrete curb forming system 20 which includes a first curb form 22 arranged to form a back of a curb. The first curb form 22, in this embodiment is formed from two identical forms 24, 26 which are stacked on top of one another; although a single form of sufficient height could be used. The first curb form 22 has a planar front face 28 and a rear face 30 with a pair of opposed channels 32 formed therein. A second curb form 34 is arranged to form a face of the curb. The second curb form 34 has a planar front face 36 and a rear face 38 with a pair of opposed channels 40 formed therein. These curb forms 22, 34 could be constructed in accordance with the teachings of U.S. Pat. Nos. 6,629,681 and 6,866,239, which are incorporated herein by reference. In an embodiment of a construction in accordance with the teachings of these patents, the curb forms 22, 35 are made out of plastic. A third curb form 41 may be provided to form a face of the curb that will be engaged by the road material, if the road is not already in place. The first 22 and third 41 curb forms are held in place by stakes 43 as discussed in the referenced patents.

Figure 2:
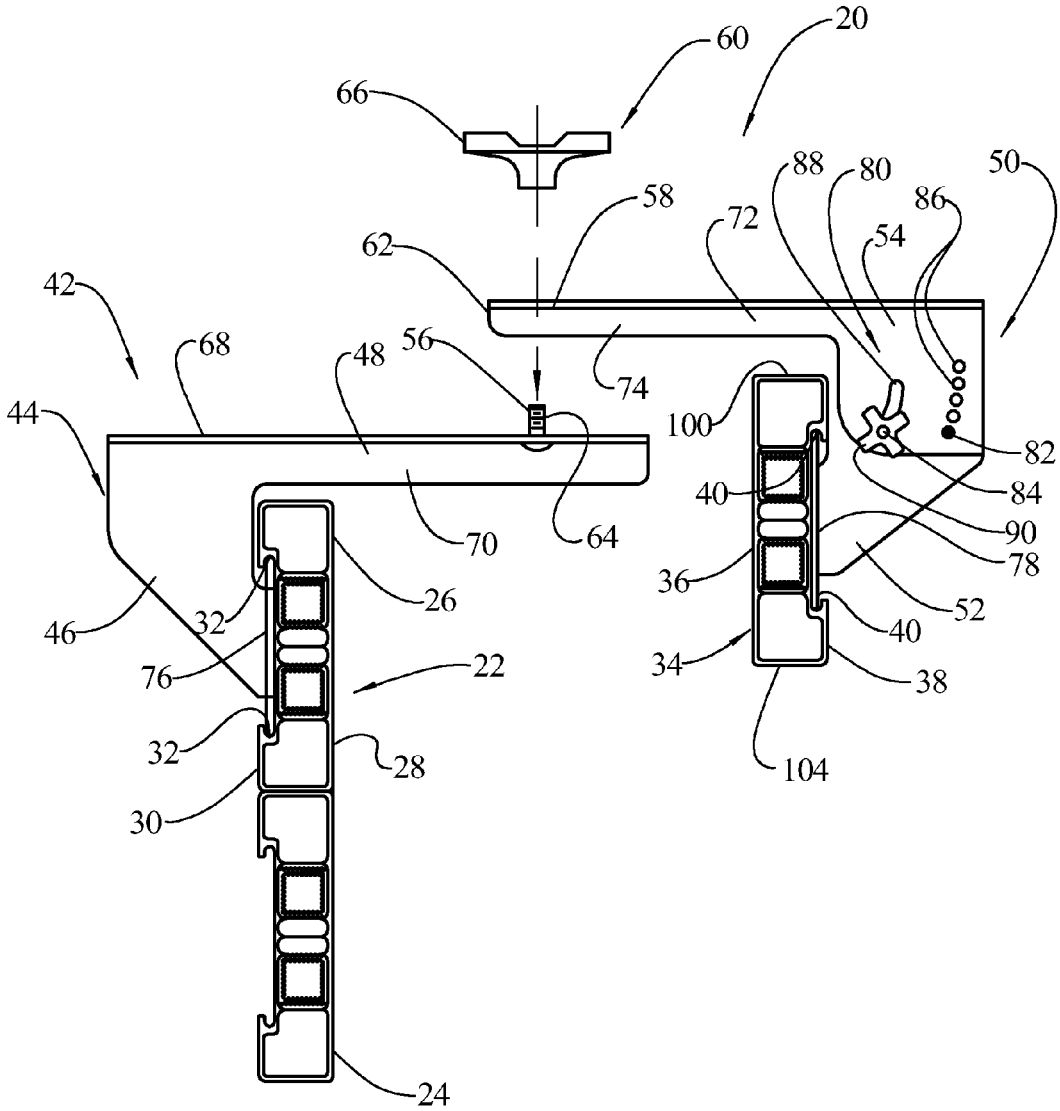
FIG. 2 depicts an end view of an unassembled overhead hanger unit that is coupled to concrete forms.
Figure 3:
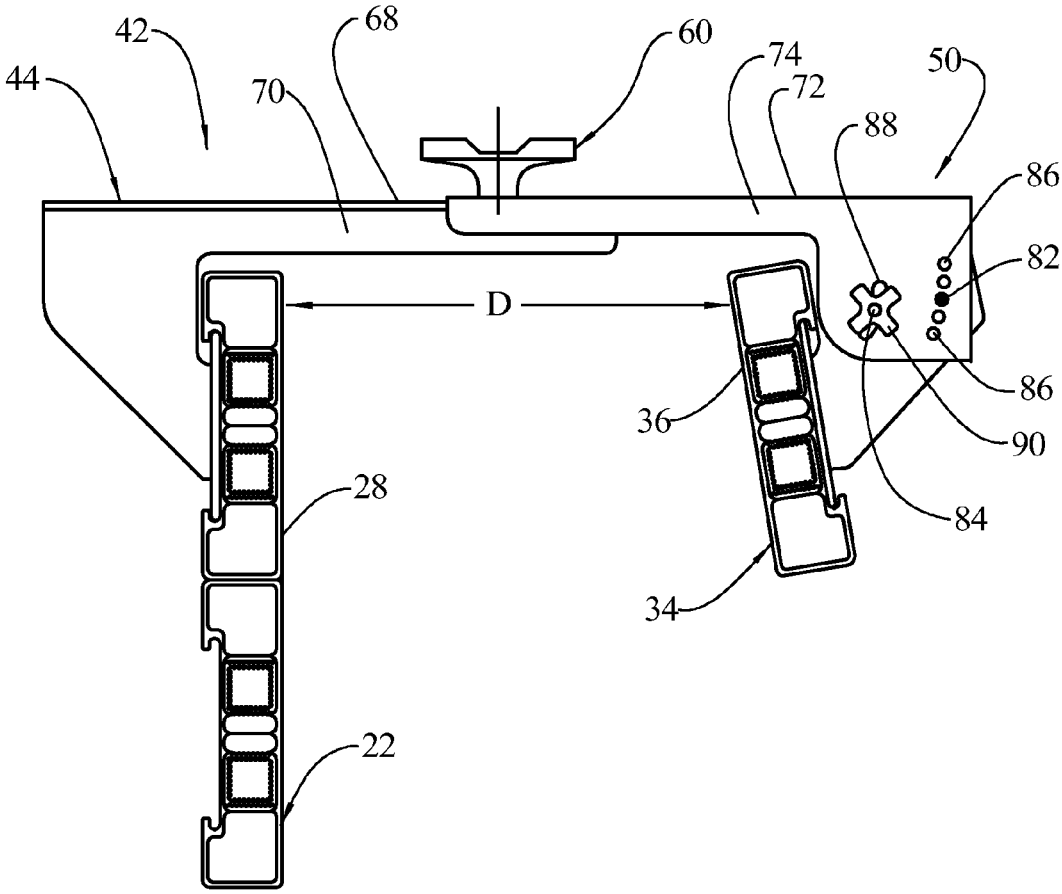
FIG. 3 depicts an end view of an assembled overhead hanger unit that is coupled to concrete forms.
Figure 4:
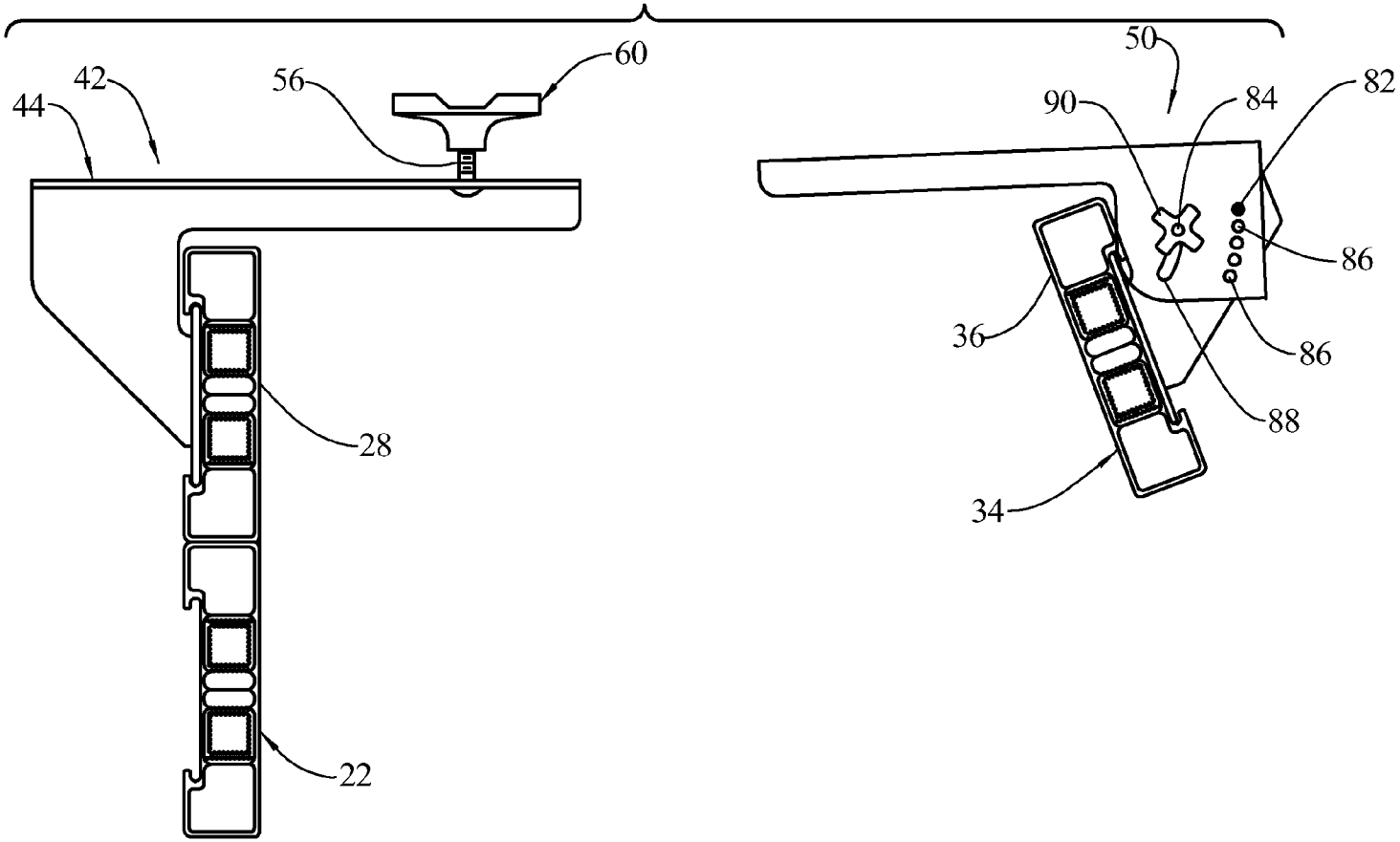
FIG. 4 illustrates another end view of an unassembled overhead hanger unit that is coupled to concrete forms.

The concrete curb forming system 20 also includes a plurality of overhead hanger units 42 to carry the second curb form 34 in a cantilevered manner relative to the first curb form 22. As best seen in FIGS. 2-4, the overhead hanger unit 42 includes a first hanger form 44 having a first portion 46 engagable with the channels 32 of the first curb form 22 and a second portion 48 extending from the first portion, and a second hanger form 50 having a first portion 52 engagable with the channels 40 of the second curb form 34 and a second portion 54 extending from the first portion.

Figure 5:
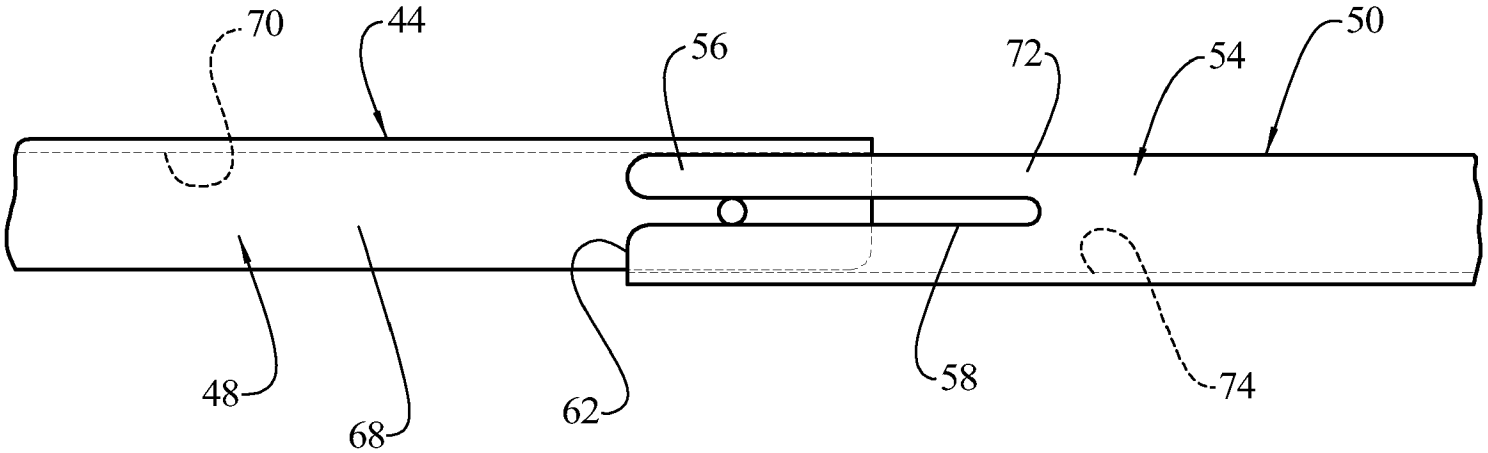
FIG. 5 is a top partial view of the overhead hanger unit.

A pin 56 is carried on the second portion 48 of the first hanger form 44. A slot 58 (see FIG. 5) is formed in the second portion 54 of the second hanger form 50. In this manner, the second portion 54 of the second hanger form 50 may be aligned with the second portion 48 of the first hanger form 44 and the pin 56 engaged with the slot 58. A coupling device 60 is engagable with the pin 56 to secure the first hanger form 44 to the second hanger form 50 at a selected position such that a distance D (FIG. 3) from the first curb form 22 to the second curb form 34 may be adjusted by an amount substantially equal to a length of the slot 58.

The pin 56 may be fixed to the first hanger form 44, such as by welding, friction, riveting, etc. so that the pin will not separate from the first hanger form during use and storage of the first hanger form, in order to avoid loss of the pin, and to decrease time required for assembly of the overhead hanger unit 42. Alternatively, the pin 56 may be loosely and removably positioned in the first hanger form 44. The slot 58 in the second hanger form 50 may open to one end 62 of the second portion 54. When the slot 58 is open at one end, the coupling device 60 may remain engaged with the pin 56, even with the first hanger form 44 separate from the second hanger form 50, such as illustrated in FIG. 4. This will allow the coupling device 60 to be permanently captured or at least retained on the pin 56, in order to avoid loss of the coupling device, and to decrease time required for assembly of the overhead hanger unit 42. Alternatively, the slot 58 may be closed at both ends.

The pin 56 may have an external thread 64 and the coupling device 60 may be an internally threaded member formed as a clamping knob with an enlarged grasping diameter 66.

The second portion 48 of the first hanger form 44 may have an L shape cross section; such that the second portion has a top wall 68 and a side wall 70. The second portion 54 of the second hanger form 50 may have an L shape cross section; such that the second portion has a top wall 72 and a side wall 74. When the first hanger form 44 and the second hanger form 50 are joined together and held in place by the connection of the pin 56 in the slot 58 secured by the coupling device 60 (as shown in FIG. 3), the side walls 70, 74 extend downwardly from opposite sides of the top walls 68, 72 such that they do not interfere with one another, but rather they provide additional strength to the first 44 and second 50 hanger forms to support the second curb form 34 which is held in a cantilevered condition.

Figure 6:
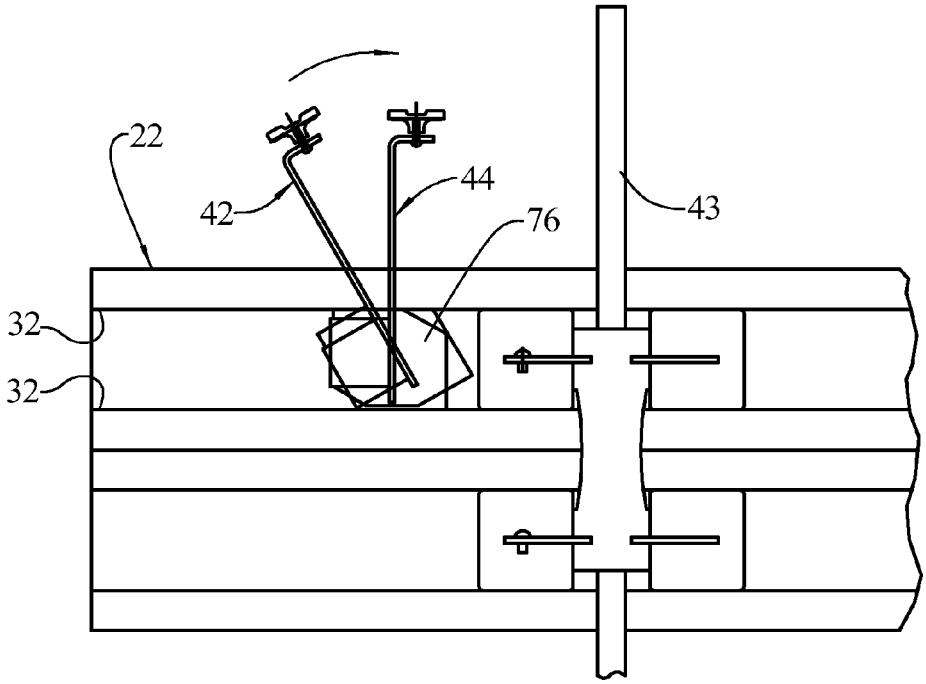
FIG. 6 depicts the overhead hanger unit in two positions of coupling to a concrete form.

In an embodiment, the first portion 46 of the first hanger form 44 includes a plate 76 for attaching to the first curb form 22. The plate 76 may attach to the curb form in a variety of manners as is known in the art. In a specific arrangement, as illustrated, the plate 76 is configured to be received in the opposing channels 32 of the rear face 30 of the first curb form 22. The corners of the plate 76 can be cut so that the plate may be inserted between the channels 32, as illustrated in FIG. 6, and then rotated to an upright position so that the plate will be captured by the channels, and held in place. The plate 76 will then be able to be slid longitudinally (horizontally) relative to the first curb form 22, but the plate, and hence the first hanger form 44 will be held in a fixed vertical position.

The first portion 52 of the second hanger form 50 includes a plate 78 for attaching to the second curb form 34. The plate 78 may attach to the curb form 34 in a variety of manners as is known in the art. In a specific arrangement, as illustrated, the plate 78 is configured to be received in the opposing channels 40 of the rear face 38 of the second curb form 34. The corners of the plate 78 can be cut so that the plate may be inserted between the channels 40, as described above relative to plate 76, and then rotated to an upright position so that the plate will be captured by the channels, and held in place. The plate 78 will then be able to be slid longitudinally (horizontally) relative to the second curb form 34, but the plate, and hence the second hanger form 50 will be held in a fixed vertical position.

In an embodiment, a pivot connection 80 is provided between the first portion 52 of the second hanger form 50 and the second portion 54 of the second hanger form, such that the first portion may be rotated at an angle relative to the second portion.

In an embodiment, the pivot connection 80 may include a pair of spaced apart pins 82, 84 carried by one of the first portion 52 and the second portion 54 of the second hanger form 50, a series of spaced holes 86 arranged in an arc to selectively receive one of the pins 82 and an arcuate slot 88 to receive the other of the pins 84, formed in the other of the first portion and the second portion of the second hanger form. A coupling device 90 is arranged to securely engage with one of the pins 82, 84 to secure the first portion 52 to the second portion 54 at a selected angle. In an embodiment, five holes 86 are arranged on the second portion 54 of the second hanger form 50 to receive the pin 82 carried on the first portion 52 of the second hanger form.

In an embodiment, the coupling unit 90 is engagable with the pin 84 extending through the slot 88. The pin 84 may have an external thread and the coupling device 90 may be an internally threaded member formed as a clamping knob with an enlarged grasping diameter.

FIG. 2 illustrated the second curb form 34 arranged in a vertical position, such that the face 36 of the second curb form will be substantially perpendicular to a surface of the road. In this position, the pin 82 is captured in the lowermost hole 86, and the pin 84 is at the lowermost end of the slot 88, and then the coupling unit 90 is fully engaged and tightened to lock the parts together. FIG. 3 illustrates an arrangement where the second curb form 34 is laid back slightly from vertical. Here the pin 82 is captured in a middle hole 86, and the pin 84 is in the middle of the slot 88 when the coupling unit is fully engaged and tightened to lock the parts together. FIG. 4 illustrates an arrangement where the second curb form 34 is laid back significantly from vertical. Here the pin 82 is captured in the top hole 86, and the pin 84 is in at the top of the slot 88 when the coupling unit is fully engaged and tightened to lock the parts together. In this position, the curb face will be formed at the greatest angle from vertical. It will be apparent to a person of skill in the art that a greater or lesser number of holes and a greater or lesser range of angles could be selected.

Figure 8:
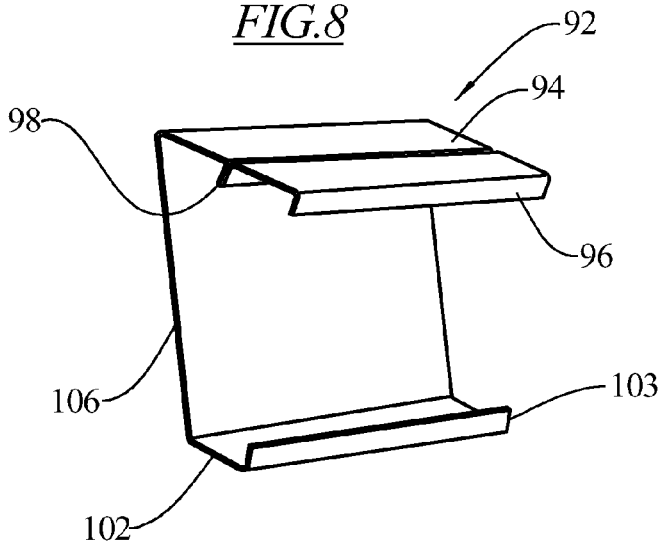
FIG. 8 is an isolated perspective view of the radius curb batter plate.
Figure 7:
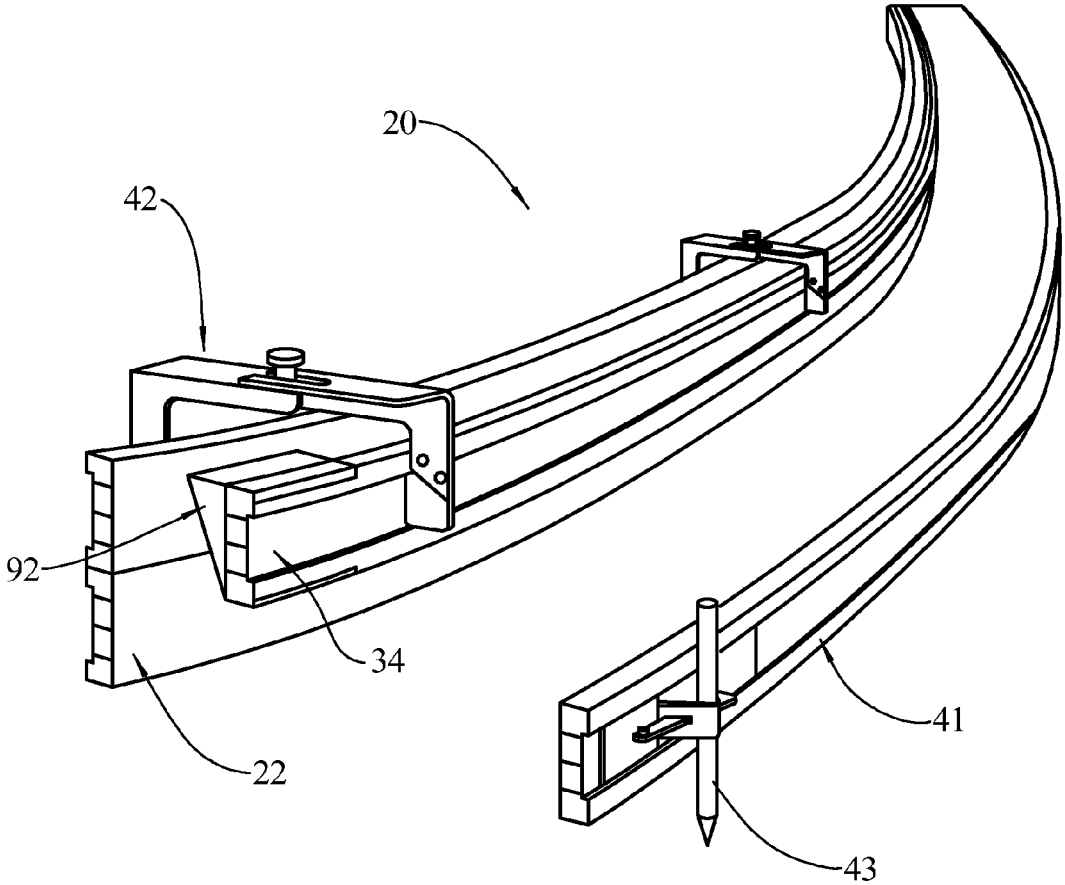
FIG. 7 shows a radius curb batter plate mounted to a concrete form.

In situations where the curbs extend around a curve, and the face of the curb is arranged at an angle other than perpendicular to the road surface, a single planar form cannot be used to form the compound curve that results. In this situation, a plurality of batter plates 92 are provided for attachment to the curb face form 34 as shown in FIG. 7 with one plate attached. The batter plate 92 is shown in isolation in FIG. 8, where it is seen to have a top portion 94 including a flange 96 and a downwardly extending ridge 98, to be removably coupled to a top 100 of the second curb form 34. The batter plate 92 also includes a bottom portion 102 with a flange 103 that may be removably coupled to a bottom 104 of the curb form 34. A side portion 106 forming a face wall connects the top portion 94 to the bottom portion 102. When the batter plate 92 is attached to the second curb form 34, the face wall 106 is aligned in a plane that is not parallel to the face 36 of the second curb form 34. As the curb form 34 is curved, the individual batter plates 92, which abut one another, will form the required compound curve in short segments.

As will be understood by those familiar with the art, methods and systems consistent with the present invention may be embodied in other specific forms without departing from the spirit or essential characteristics thereof. Likewise, the particular naming and division of the components, features, attributes, methodologies and other aspects are not mandatory or significant, and the mechanisms that implement the invention or its features may have different names, divisions and/or formats. Accordingly, the disclosure of the present invention is intended to be illustrative, but not limiting, of the scope of the invention, which is set forth in the following claims.

The invention claimed is:

1. An overhead hanger unit for concrete forms, comprising:

a first hanger form having a first portion engagable with a first curb form and a second portion extending from the first portion, the second portion of the first hanger form having an L shape cross section formed by a top wall and a depending side wall, a second hanger form having a first portion engagable with a second curb form and a second portion extending from the first portion, the second portion of the second hanger form having an L shape cross section formed by a top wall and a depending side wall, a pin engaged with the top wall of the second portion of the first hanger form, a slot formed in the top wall of the second portion of the second hanger form, wherein the top wall of the second portion of the second hanger form overlaps with the top wall of the second portion of the first hanger form and the pin is engaged with the slot, and the depending side wall of the first hanger form being spaced from, but parallel to the depending side wall of the second hanger form, a coupling device engagable with the pin to secure the first hanger form to the second hanger form at a selected position such that a distance from the first curb form to the second curb form may be adjusted by an amount substantially equal to a length of the slot.

2. The overhead hanger unit according to claim 1, wherein the slot in the second hanger form opens to one end of the second portion.

3. The overhead hanger unit according to claim 1, wherein the pin has an external thread and the coupling device is an internally threaded member formed as a clamping knob with an enlarged grasping diameter.

4. The overhead hanger unit according to claim 1, wherein the first portion of the first hanger form includes a plate for attaching to the curb form.

5. The overhead hanger unit according to claim 1, including a pivot connection between the first portion of the second hanger form and the second portion of the second hanger form, such that the first portion may be rotated at an angle relative to the second portion.

6. The overhead hanger unit according to claim 1, and further including a first curb form made of a flexible material having a planar front face and a rear face with a pair of opposed channel formed therein, and a second curb form made of a flexible material having a planar front face and a rear face with a pair of opposed channels formed therein, the first portion of the first hanger form being engagable with the channels of the first curb form and the first portion of the second hanger form being engagable with the channels of the second curb form.

7. An overhead hanger unit for concrete forms, comprising:

a first hanger form having a first portion engagable with a first curb form and a second portion extending from the first portion, a second hanger form having a first portion engagable with a second curb form and a second portion extending from the first portion, a pivot connection between the first portion of the second hanger form and the second portion of the second hanger form, such that the first portion may be rotated at an angle relative to the second portion, the pivot connection comprises a pair of spaced apart pins carried by one of the first portion and the second portion of the second hanger form and a series of spaced holes arranged in an arc to selectively receive a first one of the pins and an arcuate slot to receive a second one of the pins, formed in the other of the first portion and the second portion of the second hanger form, the concavity of the arc of the holes arranged in the same direction as the concavity of the arcuate slot such that the first portion of the second hanger form will pivot relative to the second portion of the second hanger form about a point which is spaced away from both of the first and second pins, and a coupling device arranged to securely engage with one of the pins to secure the first portion to the second portion at a selected angle.

8. The overhead hanger unit according to claim 7, and further including a first curb form made of a flexible material having a planar front face and a rear face with a pair of opposed channel formed therein, and a second curb form made of a flexible material having a planar front face and a rear face with a pair of opposed channels formed therein, the first portion of the first hanger form being engagable with the channels of the first curb form and the first portion of the second hanger form being engagable with the channels of the second curb form.

9. The overhead hanger unit according to claim 7, wherein five holes are arranged in the arc on the second portion of the second hanger form to alternately receive the pin carried on the first portion of the second hanger form.

10. The overhead hanger unit according to claim 7, wherein the coupling device is engagable with the pin extending through the slot which has an external thread and the coupling device is an internally threaded member formed as a clamping knob with an enlarged grasping diameter.

11. The overhead hanger unit according to claim 7, wherein the first portion of the first hanger form includes a plate for attaching to the curb form.

12. The overhead hanger unit according to claim 7, wherein the second portion of the first hanger form has an L shape cross section formed by a top wall and a depending side wall and the second portion of the second hanger form has an L shape cross section formed by a top wall and a depending side wall, and further including a pin fixed to the top wall of the second portion of the first hanger form, and a slot formed in the top wall of the second portion of the second hanger form, wherein the top wall of the second portion of the second hanger form may be overlaid on the top wall of the second portion of the first hanger form and the pin engaged with the slot, the depending side wall of the first hanger form being spaced from, but parallel to the depending side wall of the second hanger form.

13. A concrete curb forming system comprising:

a first flexible curb form arranged to form a back of a curb, the first curb form having a planar front face, a rear face with a pair of opposed channels formed therein, and a longitudinal length extending in the direction of the channel, a second flexible curb form arranged to form a face of the curb, the second curb form having a planar front face, a rear face with a pair of opposed channels formed therein, and a longitudinal length extending in the direction of the channels, an overhead hanger unit, comprising:

a first hanger form having a first portion engagable with the channels of the first curb form and a second portion extending from the first portion, a second hanger form having a first portion engagable with the channels of the second curb form and a second portion extending from the first portion, a pin carried on the second portion of the first hanger form, a slot formed in the second portion of the second hanger form, wherein the second portion of the second hanger form may be aligned with the second portion of the first hanger form and the pin engaged with the slot, a coupling device engagable with the pin to secure the first hanger form to the second hanger form, and a batter plate removably coupled to one of the first and second flexible curb forms, the batter plate having:

a batter plate top portion, including a flange and a downwardly extending ridge, that is removably coupled to a top of the respective first or second curb form, a batter plate bottom portion, including a flange, that is removably coupled to a bottom of the respective first or second curb form, a batter plate side portion connected to the batter plate top portion and the batter plate bottom portion, a face of the batter plate side portion aligned in a plane that is not parallel to the planar front face of the first or second curb form to which the batter plate is coupled, the batter plate having a longitudinal length extending in the direction of the longitudinal length of the curb form to which it is coupled which is substantially shorter than the longitudinal length of the coupled curb form.

14. The concrete curb forming system according to claim 13, wherein the first portion of the first hanger form includes a plate for rotatingly engaging with the channels in the first curb form.

15. The concrete curb forming system according to claim 13, including a pivot connection between the first portion of the second hanger form and the second portion of the second hanger form, such that the first portion may be rotated at an angle relative to the second portion.

16. The concrete curb forming system according to claim 15, wherein the pivot connection comprises a pair of spaced apart pins carried by one of the first portion and the second portion of the second hanger form and a series of spaced holes arranged in an arc to selectively receive a first of the pins and an arcuate slot to receive a second of the pins, formed in the other of the first portion and the second portion of the second hanger form, and a coupling device arranged to securely engage with one of the pins to secure the first portion to the second portion at a selected angle.

17. The concrete curb forming system according to claim 16, wherein five holes are arranged on the second portion of the second hanger form to receive the pin carried on the first portion of the second hanger form.

18. The concrete curb forming system according to claim 16, wherein the coupling unit is engagable with the pin extending through the slot which has an external thread and the coupling device is an internally threaded member formed as a clamping knob with an enlarged grasping diameter.

19. The concrete curb forming system according to claim 13, wherein the second portion of the first hanger form has an L shape cross section formed by a top wall and a depending side wall, and the second portion of the second hanger form has an L shape cross section formed by a top wall and a depending side wall, the top wall of the second portion of the second hanger form being overlaid on the top wall of the second portion of the first hanger form and the pin engaged with the slot, the depending side wall of the first hanger form being spaced from, but parallel to the depending side wall of the second hanger form.

20. The concrete curb forming system according to claim 13, wherein the first curb form and the second curb form are made of plastic.

* * * * *